US009653010B2

(12) United States Patent
Ouchi

(10) Patent No.: US 9,653,010 B2
(45) Date of Patent: May 16, 2017

(54) IMAGE PROCESSING APPARATUS, IMAGE PROCESSING METHOD AND STORAGE MEDIUM

(71) Applicant: CANON KABUSHIKI KAISHA, Tokyo (JP)

(72) Inventor: Akihiro Ouchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 183 days.

(21) Appl. No.: 14/078,935

(22) Filed: Nov. 13, 2013

(65) Prior Publication Data

US 2014/0168283 A1 Jun. 19, 2014

(30) Foreign Application Priority Data

Dec. 17, 2012 (JP) ..... 2012-275099

(51) Int. Cl.
*G09G 3/00* (2006.01)

(52) U.S. Cl.
CPC ..... *G09G 3/002* (2013.01); *G09G 2300/026* (2013.01); *G09G 2320/0233* (2013.01); *G09G 2320/0271* (2013.01); *G09G 2320/0285* (2013.01)

(58) Field of Classification Search
CPC .. G09G 3/20; G09G 5/00; G09G 5/10; G06K 9/36; H04N 7/00
See application file for complete search history.

(56) References Cited

U.S. PATENT DOCUMENTS 5,668,569 A * 9/1997 Greene et al. ..... 345/103
7,292,207 B1 * 11/2007 Naegle et al. ..... 345/1.3
7,898,501 B2 * 3/2011 Jang ..... G06F 1/1616 345/1.3
2002/0057361 A1 * 5/2002 Mayer, III ..... G03B 21/00 348/383

FOREIGN PATENT DOCUMENTS

JP 2002-268625 A 9/2002
JP 2012-234072 A 11/2012

OTHER PUBLICATIONS

2002268625JPA.tran (PDF file); Inventor: Kokubo, Atsushi English translation of JP 2002-268625, published Sep. 20, 2002; made of record in the IDS submitted on Nov. 13, 2013.*

* cited by examiner

*Primary Examiner* — Amr Awad
*Assistant Examiner* — Wing Chow
(74) *Attorney, Agent, or Firm* — Fitzpatrick, Cella, Harper & Scinto

(57) ABSTRACT

An image processing apparatus, which generates low gradation luminance correction values with respect to an overlap region and a non-overlap region of a plurality of images constituting a multi-screen display, generates the low gradation luminance correction values so as to make the values gradually change from the overlap region throughout the non-overlap region.

13 Claims, 5 Drawing Sheets

IMAGE PROCESSING APPARATUS, IMAGE PROCESSING METHOD AND STORAGE MEDIUM

BACKGROUND OF THE INVENTION

Field of the Invention

The present invention relates to an image processing apparatus and method which are useful in forming a multi-screen using a plurality of image display apparatuses.

Description of the Related Art

Conventionally, when forming a multi-screen by using a plurality of projection type image display apparatuses (to be referred to as image display apparatuses hereinafter), performing luminance correction for an image signal from a region where images from adjacent image display apparatuses overlap implements overall luminance evenness. It is also known that setting an image overlap region with an arbitrary width makes it difficult to visibly recognize even slight differences in display characteristics such as luminance and color tone between image display apparatuses.

In this case, an image display apparatus cannot completely cut off transmitted light when it is of a transmission type or cannot completely cut off reflected light when it is of a reflection type, and hence has a slight luminance even in the black display state. For this reason, in the black display or low gradation display state of a multi-screen arrangement, an image overlap region (to be referred to as an overlap region hereinafter) is higher in luminance than a non-image overlap region (to be referred to a non-overlap region hereinafter), resulting in an uneven luminance. This causes the problem of so-called black floating. Under the circumstances, there has been disclosed a technique which includes independent units for adjusting the luminance of an image overlap region and the luminance of a non-image overlap region and implements luminance evenness in a low gradation display state by independently correcting the luminance level of the non-image overlap region (for example, Japanese Patent Laid-Open No. 2002-268625).

The luminance correction method disclosed in Japanese Patent Laid-Open No. 2002-268625 will be described with reference to FIG. 5. FIG. 5 shows overlap luminances, black correction luminances, and corrected composite luminances for an overlap region and a non-overlap region. In FIG. 5, (5B) indicates the overlap luminance of the overlap region and non-overlap region. In this case, a black correction luminance like that indicated by (5A) in FIG. 5 is used. That is, this corrects the luminances with a correction value of 0 for the overlap region and a significant correction value for the non-overlap region. As a result, a constant composite luminance is obtained as indicated by (5C) in FIG. 5.

However, the overlap accuracy of an image overlap region is not always high as indicated by (5B) in FIG. 5. If the overlap accuracy of an image overlap region is low, the boundary between an overlap region and a non-overlap region shifts to the right as indicated by (5D) in FIG. 5 or shifts to the left as indicated by (5F) in FIG. 5, thus causing a shift phenomenon. When applying a black correction luminance like that indicated by (5A) in FIG. 5 to the former case, the luminance distribution after the correction increases in luminance at the boundary by the shift amount as indicated by (5E) in FIG. 5. When applying a black correction luminance like that indicated by (5A) in FIG. 5 to the latter case, the luminance distribution after the correction decreases in luminance at the boundary by the shift amount as indicated by (5G) in FIG. 5. In either case, the user visibly recognizes a luminance level difference by the shift amount at the boundary between the overlap region and the non-overlap region.

Furthermore, in some case, no luminance edge appears at an end portion of an overlap image, as indicated by (5H) in FIG. 5, due to the low gradation display luminance scattering of an effective image as indicated by (5H) in FIG. 5. In this case, even if an overlap region accurately overlaps a non-overlap region, applying a black correction luminance like that indicated by (5A) in FIG. 5 to the resultant image makes the user visibly recognize a luminance level difference at the boundary in the luminance distribution after correction, as indicated by (5I) in FIG. 5.

SUMMARY OF THE INVENTION

The present invention has been made in consideration of the above problem, and provides an image processing apparatus which can form a multi-screen display on which no luminance level difference is visibly recognized even in the black or low gradation display state.

According to a one aspect of the present invention, there is provided an image processing apparatus which generates low gradation luminance correction values with respect to an overlap region and a non-overlap region of a plurality of images constituting a multi-screen display, comprising a generation unit configured to generate the low gradation luminance correction values so as to make the values gradually change from the overlap region throughout the non-overlap region.

Further features of the present invention will become apparent from the following description of exemplary embodiments (with reference to the attached drawings).

DESCRIPTION OF THE EMBODIMENTS

The embodiments of the present invention will be described below with reference to the accompanying drawings.

[First Embodiment]

Figure 1:
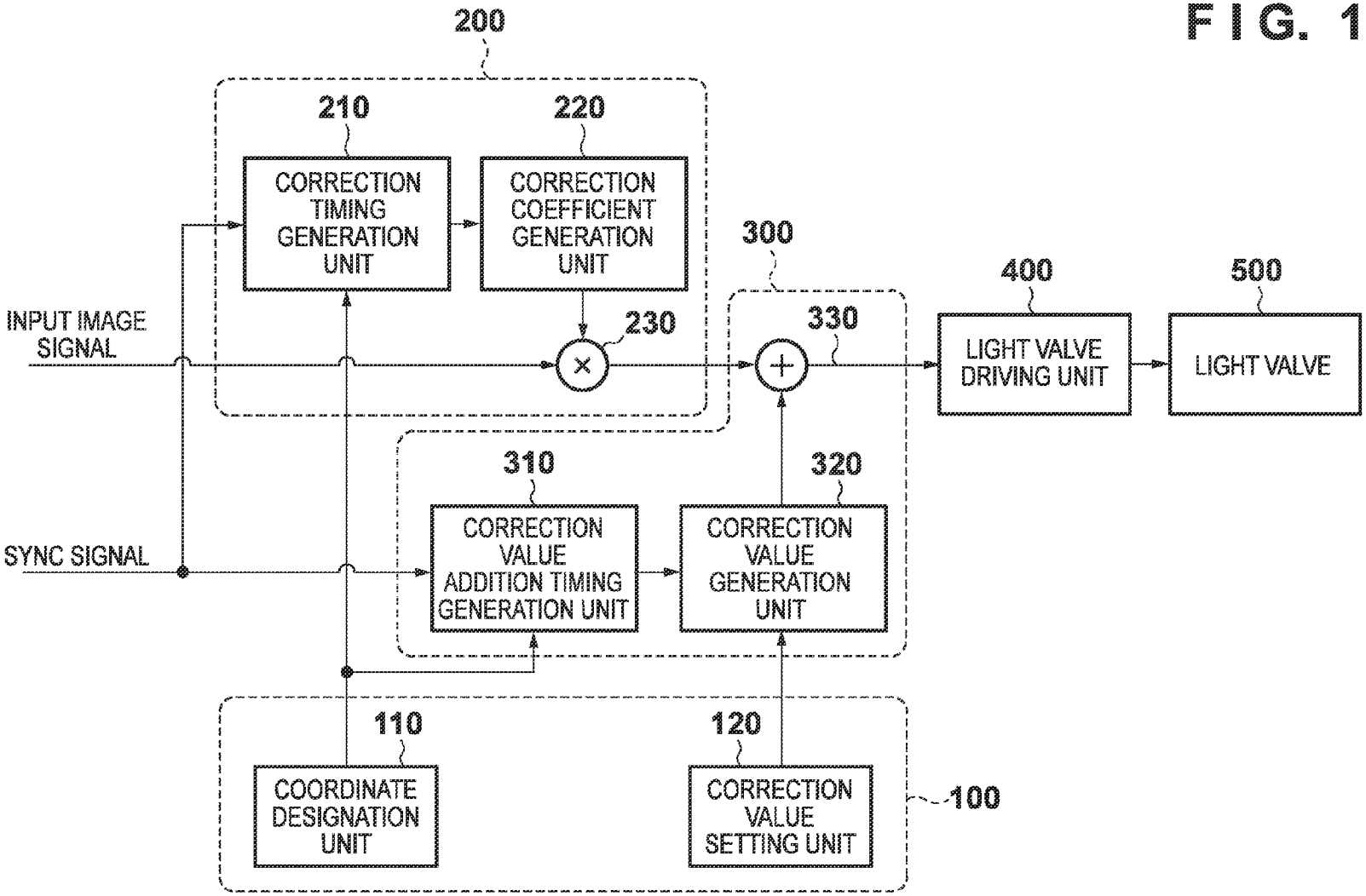
FIG. 1 is a schematic block diagram of an image display apparatus according to the first embodiment.

FIG. 1 is a schematic block diagram of an image processing apparatus according to this embodiment.

This arrangement includes a control unit 100, an overlap portion correction circuit 200, a low gradation display correction unit 300, a light valve driving unit 400, and a light valve 500. When forming a multi-screen display by using a plurality of image display apparatuses, there is provided an image overlap region where adjacent images overlap.

The control unit 100 includes a coordinate designation unit 110 and a correction value setting unit 120. The coordinate designation unit 110 is a unit for designating an image overlap region. In general, a region divided from an image end portion with the coordinates designated by the coordinate designation unit 110 is an overlap region, and the remaining region is a non-overlap region. In this embodiment, only the coordinate designation unit 110 is used to designate regions for the overlap portion correction circuit 200 and the low gradation display correction unit 300. However, the embodiment may include units for individually designating regions for the respective correction units. The correction value setting unit 120 sets a correction value.

The overlap portion correction circuit 200 includes a correction timing generation unit 210, a correction coefficient generation unit 220, and a multiplication unit 230. The correction timing generation unit 210 generates a pixel position in an overlap region based on the coordinates designated by the coordinate designation unit 110 and an externally input sync signal. The correction coefficient generation unit 220 generates correction coefficients in an overlap region based on the pixel position generated by the correction timing generation unit 210. The multiplication unit 230 performs luminance correction by multiplying an input image signal by the correction coefficients generated by the correction coefficient generation unit 220.

The correction coefficient generation unit 220 generates, for an image to overlap, correction coefficients to make an image signal on an overlap region end of an image end portion 0% and make an image signal on the overlap region end inside the image 100%. The image processing apparatus which displays an image to be overlapped performs similar overlap luminance correction, and generates correction coefficients to make an image signal on an overlap region end of an image end portion 100% and make an image signal on the overlap image region end inside the image 0%. Performing luminance correction based on the correction coefficients generated in this manner can implement overall luminance evenness.

The low gradation display correction unit 300 is a unit for correcting the luminance of a low gradation display for each of the regions (an overlap region and a non-overlap region) divided by the coordinates designated by the coordinate designation unit 110, and includes a correction value addition timing generation unit 310, a correction value generation unit 320, and an addition unit 330. The correction value addition timing generation unit 310 generates a timing to add a low gradation correction value based on the coordinates designated by the coordinate designation unit 110 and an externally input sync signal. The correction value generation unit 320 generates a low gradation correction value for implementing luminance evenness on a low gradation display at the timing generated by the correction value addition timing generation unit 310 based on the correction value set by the correction value setting unit 120. The addition unit 330 adds the low gradation correction value generated by the correction value generation unit 320 to the image signal having undergone luminance correction by the overlap portion correction circuit 200. The image having undergone luminance correction for overlap regions by the overlap portion correction circuit 200 and low gradation display correction by the low gradation display correction unit 300 is projected via the light valve driving unit 400 and the light valve 500.

Figure 2:
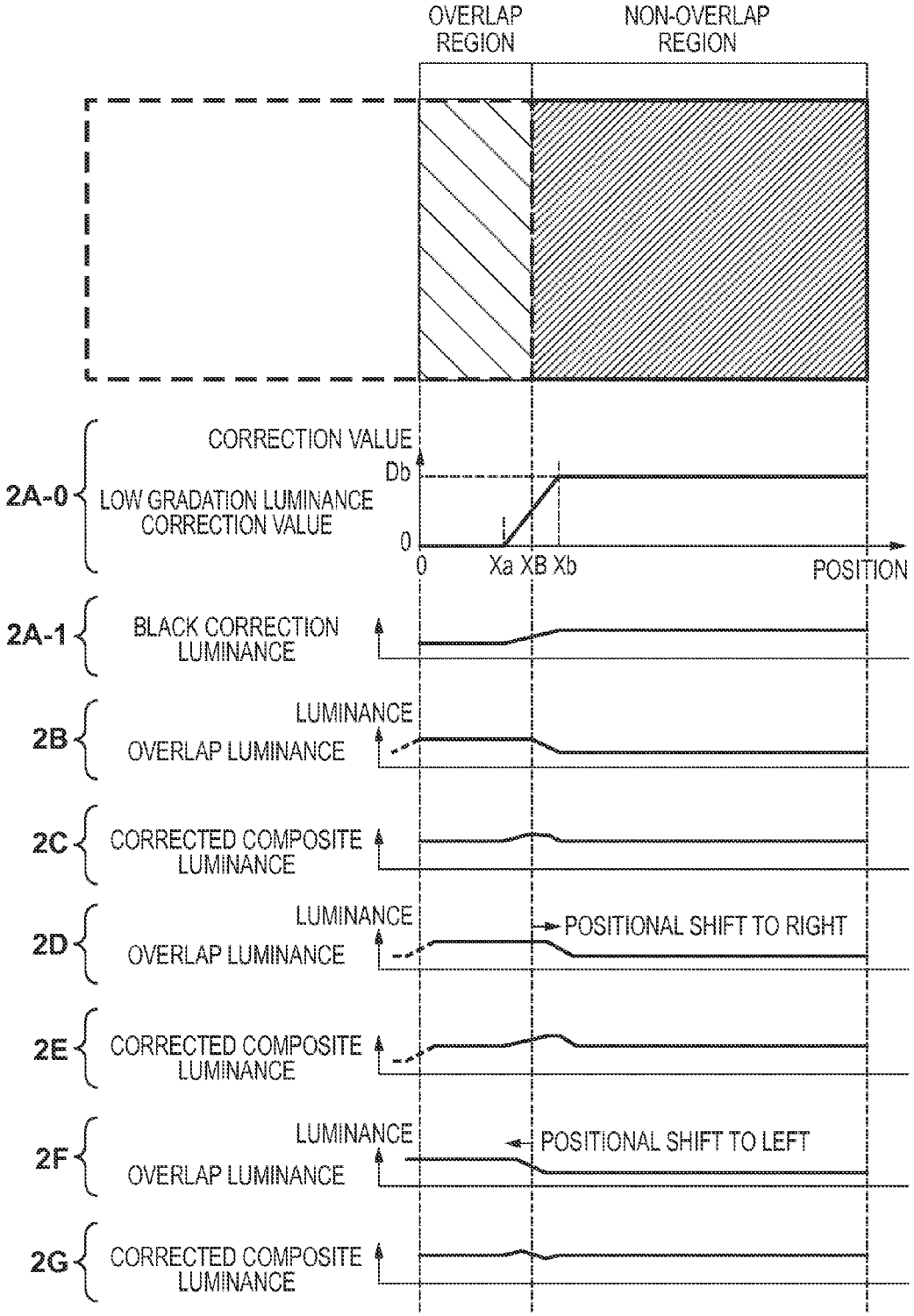
FIG. 2 shows a luminance correction method according to the first embodiment.

FIG. 2 shows a luminance correction method according to this embodiment and low gradation luminance correction values, black correction luminances, overlap luminances, and corrected composite luminances. Assume that the overlap luminance indicated by (2B) in FIG. 2 has no luminance edge due to scattered-light like the overlap luminance indicated by (5H) in FIG. 5.

As indicated by (2A-0) in FIG. 2, the coordinate designation unit 110 designates a horizontal coordinate XB on the left side of the image. In this case, as shown in FIG. 2, the low gradation display correction unit 300 generates luminance correction values which gradually change from values in one region to values in the other region. In this case, positional coordinates ranging from a positional coordinate 0 to the positional coordinate XB define an overlap region, and positional coordinates following the positional coordinate XB define a non-overlap region region.

Letting 0 be a low gradation luminance correction value in an overlap region and Db be a low gradation luminance correction value in a non-overlap region, an example of a correction value Hd indicated by (2A-0) in FIG. 2 is expressed by $$\begin{aligned} Hd &= 0(x < Xa) \\ &= 0 + (x - Xa)/(Xb - Xa) \times Db(Xa \le x < Xb) \\ &= Db(Xb \le x) \end{aligned} \tag{1}$$

Correcting the low gradation luminances with the correction values expressed by equation (1) will obtain black correction luminances like those indicated by (2A-1) in FIG. 2. Correcting overlap luminances like those indicated by (2B) in FIG. 2 with these black correction luminances will obtain an almost composite luminance distribution like that indicated by (2C) in FIG. 2. When the boundary between the overlap region and the non-overlap region shifts to the right as indicated by (2D) in FIG. 2, applying black correction luminances like those indicated by (2B) in FIG. 2 to the regions will obtain a composite luminance distribution like that indicated by (2E) in FIG. 2. When the boundary between the overlap region and the non-overlap region shifts to the left as indicated by (2F) in FIG. 2, a composite luminance distribution like that indicated by (2G) in FIG. 2 is obtained. In either case, although a slight luminance level difference occurs at only the positional coordinate XB, since the width of this region is small, it is possible to make it difficult to visibly recognize the luminance level difference. Note that it is possible to set Xa and Xb to arbitrary values whose differences from XB are not 0. In addition, correction values are not limited to those expressed by equation equation (1) and may be those which gradually decrease from an overlap region toward a non-overlap region or may have a curve form like an S shape.

This embodiment can make it easy to visibly recognize a luminance level difference occurring at the boundary between an overlap region and a non-overlap region even if the overlap accuracy of an image overlap region is low. This can provide a multi-screen display having no noticeable joint line even on a black display without degrading a sense of oneness.

[Second Embodiment]

Figure 3A:
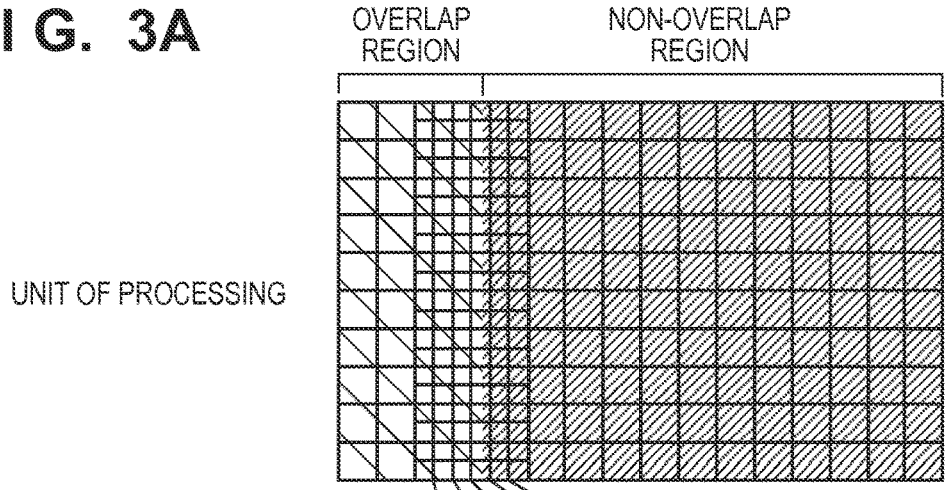
FIGS. 3A to 3C are views for explaining a luminance correction method according to the second embodiment.

In the first embodiment, the correction value setting unit 120 sets a low gradation luminance correction value (for example, Db given by equation (1)) in the correction value generation unit 320 for low gradation correction. In consideration of a case in which low gradation luminance correction values are not uniform within a plane, there is conceivable an arrangement configured to divide a display into units of processing and set a low gradation luminance correction value to be used for each unit of processing by using LUT (Look-Up Table). In this case, as a display is divided into smaller units of processing, the number of correction values set in a LUT becomes larger. In contrast to this, as a display is divided into larger units of processing, the accuracy of low gradation luminance correction deteriorates. In this embodiment, as indicated in FIG. 3A, with regard to the units of processing divided with the coordinates designated by a coordinate designation unit 110, the units of processing in portions including portions near the boundary between an overlap region and a non-overlap region are made small in particular. This can decrease the number of correction values set in the LUT. Assume that regions where small units of processing are set are ranges each including at least two units of processing on each of the overlap region side and the non-overlap region side located on the two sides of the boundary between an overlap region and a non-overlap region.

Figure 3B:
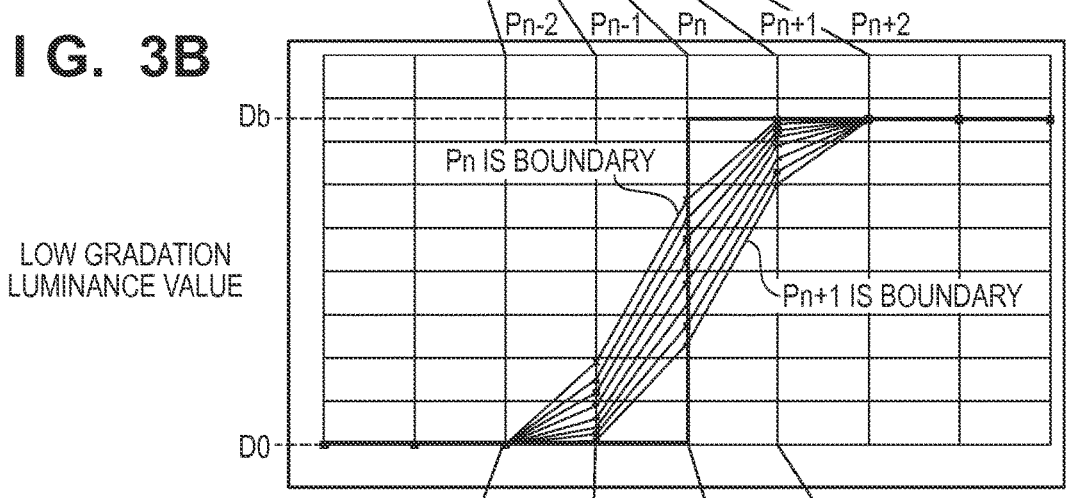

This embodiment implements the correction value characteristics indicated by (2A-0) in FIG. 2 with the correction values set in the LUT. The low gradation correction values stored in the LUT will be described below. First of all, as indicated in FIG. 3B, consider a case in which reference symbols Pn−2 to Pn+2 denote grid points (points divided in a grid) in units of processing near the boundary between an overlap region and a non-overlap region, and the boundary is located between Pn and Pn+1. In this embodiment, the number of grid points used for low gradation luminance correction value calculation is 4, Pn is a reference grid point, and two grid points Pn−2 and Pn−1 on the overlap region side and one grid point Pn+1 on the non-overlap region side are used.

Figure 3C:
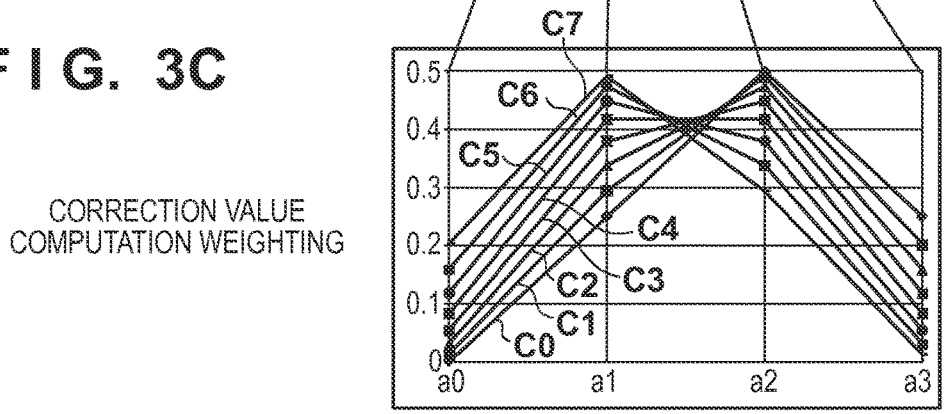
Figure 5:
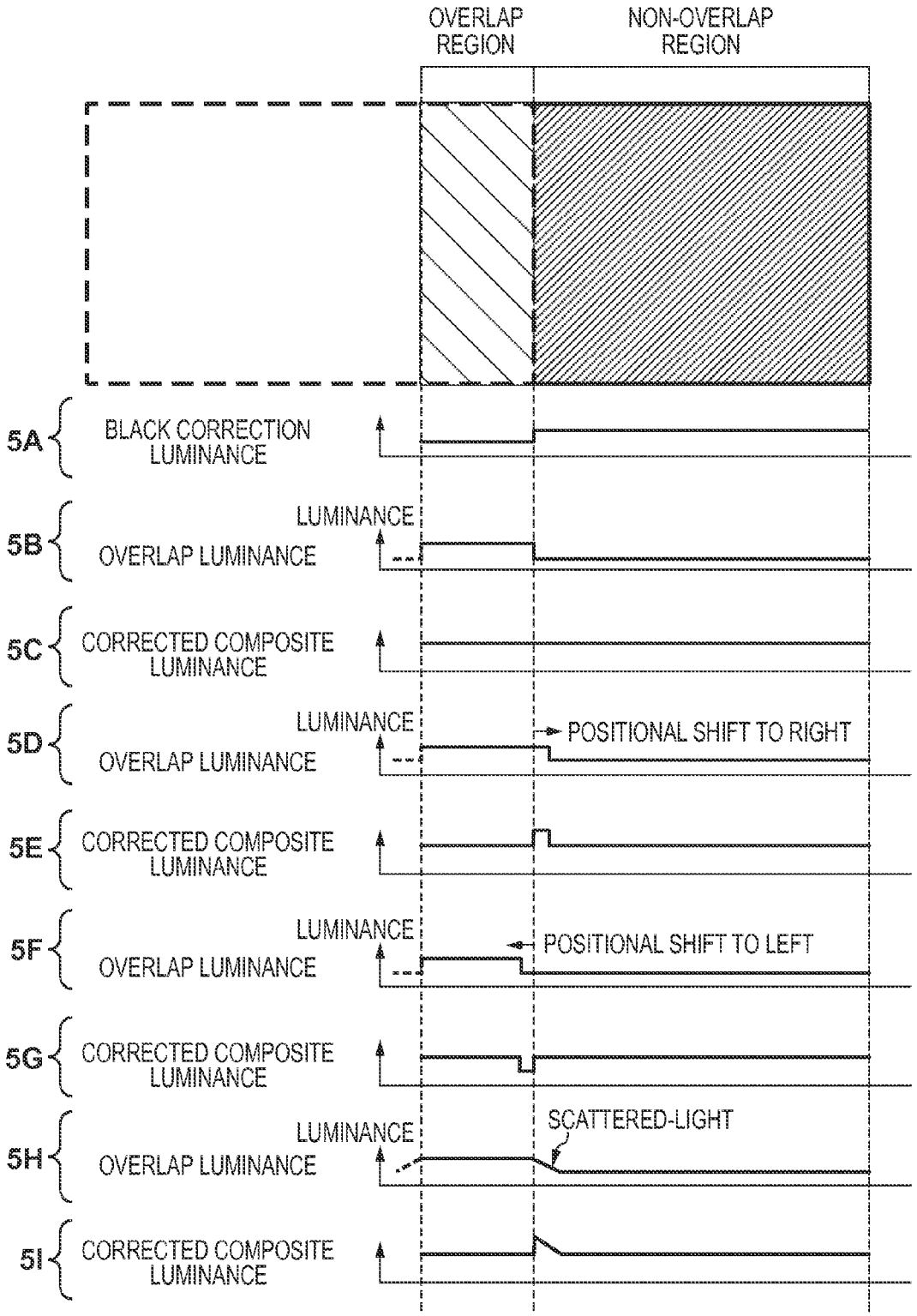
FIG. 5 shows a conventional luminance correction method.

As shown in FIG. 5, conventional low gradation luminance correction values Hn−2 to Hn+1 at the grid points Pn−2 to Pn+1 are defined as follows: Hn−2=Hn−1=D0 and Hn=Hn+1=Db. Assume that in this embodiment, the low gradation correction values (first correction values) Hn−2 to Hn+1 are assigned to the grid points Pn−2 to Pn+1 in advance. For example, a low gradation luminance correction value (second correction value) is calculated at the grid point Pn by using the first correction values Hn−2 to Hn+1 and weighting coefficients corresponding to positions on the boundary between the overlap region and the non-overlap region according to equation (2):

$$Hd(Ph)=a0\times Hn-2+a1\times Hn-1+a2\times Hn+a3\times Hn+1 \quad (2)$$

where one set of weighting coefficients a0 to a3 are prepared in accordance with positions on the actual boundary in units of processing, and characteristics like those indicated in FIG. 3C are prepared. That is, when the boundary between the overlap region and the non-overlap region coincides with the grid point Pn, a0 to a3 are used as weighting coefficients concerning C0. As the boundary between the overlap region and the non-overlap region approaches the grid point Pn+1, the apparatus uses a0 to a3 concerning C1, C2, . . . . This embodiment sets the interval between the grid points Pn and Pn+1 to eight pixels and includes eight weighting coefficients. As a result, it is possible to use low gradation luminance correction values like those indicated in FIG. 3B. Obtained low gradation luminance correction values are stored in the LUT in correspondence with the positions of grid points. Subsequently, the apparatus performs low gradation luminance correction by reading out correction values stored in the LUT. Note that the coordinate designation unit 110 may be configured to detect an actual boundary or the user may manually designate a boundary.

It is possible to obtain a low gradation luminance correction value for a pixel located between grid points from low gradation luminance correction values at two grid points located on the two sides of the pixel by linear interpolation, as indicated in FIG. 3B. The apparatus may be configured to directly use low gradation luminance correction values at adjacent grid points without any interpolation. Note that the number of grid points used for low gradation luminance correction values and grid point intervals are not limited to the numeral values described in this embodiment.

This embodiment can make it easy to visibly recognize a luminance level difference occurring at the boundary between an overlap region and a non-overlap region even when setting low gradation luminance correction values with a LUT. This can provide a multi-screen display having no noticeable joint line even on a black display without degrading a sense of oneness.

[Third Embodiment]

Figure 4:
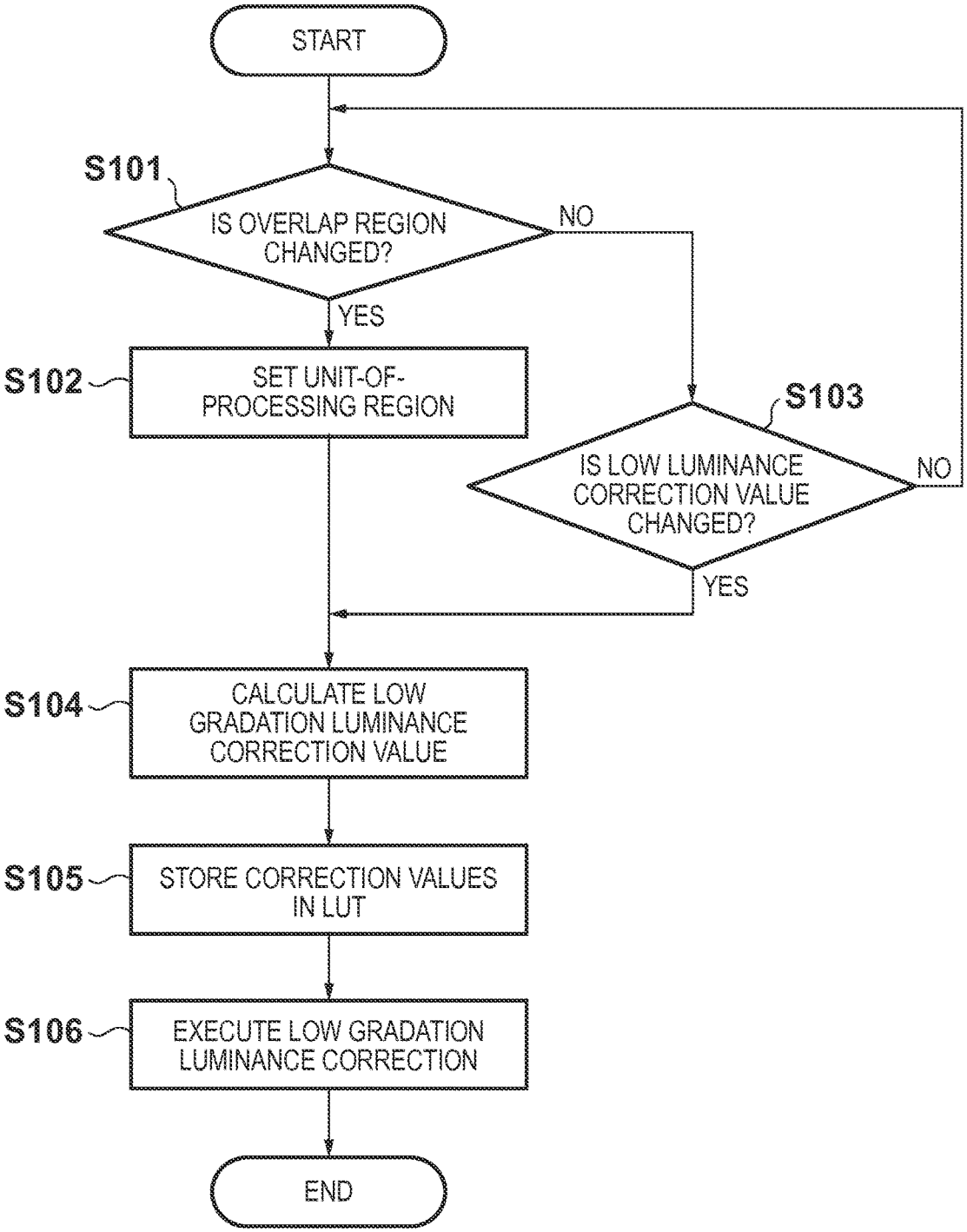
FIG. 4 is a flowchart for explaining a procedure for the luminance correction method according to the third embodiment.

When implementing a multi-screen using a plurality of image display apparatuses, the overlap region between adjacent images changes in accordance with the arrangement of the plurality of image display apparatuses. For this reason, in general, the control unit (for example, menu operation using OSD (On-Screen Display)) of a projection type image display apparatus sets an overlap region. This embodiment can perform low luminance correction in accordance with overlap region setting by the control unit by executing the low luminance correction value generation method according to the second embodiment in accordance with the procedure described with reference to FIG. 4. The procedure will be described below with reference to FIG. 4.

First of all, in step S101, the apparatus determines whether a coordinate designation unit 110 has set any overlap region. If the coordinate designation unit 110 has set no overlap region, the process advances to step S103. If the coordinate designation unit 110 has set an overlap region, the apparatus sets unit-of-processing areas in accordance with the overlap region boundary with an adjacent image in step S102, and the process advances to step S104. In this case, the apparatus sets units of processing so as to set small units only near the boundary between an overlap region and a non-overlap region which is divided with the coordinates designated by the coordinate designation unit 110 and set large units in the remaining region, as shown in FIG. 3A. In step S103, the apparatus determines whether a correction value setting unit 120 has set any luminance correction value. If the correction value setting unit 120 has set no luminance correction value, the process returns to step S101. If the correction value setting unit 120 has set luminance correction values, the process advances to step S104 to calculate low gradation luminance correction values in accordance with the set units of processing. In this case, the apparatus calculates low gradation luminance correction values by the calculation method described in the second embodiment. The apparatus stores the calculated low gradation luminance correction values in a LUT in correspondence with the positions of grid points in step S105. In step S106, the apparatus performs low gradation luminance correction by using the low gradation luminance correction values stored in the LUT.

This embodiment can perform luminance correction by calculating low gradation luminance correction values in accordance with the image overlap region set by the control unit of the image display apparatus and luminance correction values. This allows the user to form a multi-screen display having no noticeable joint line even on a black display without degrading a sense of oneness by using a simple method.

[Other Embodiments]

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-275099, filed on Dec. 17, 2012 which is hereby incorporated by reference herein in its entirety.

What is claimed is:

1. An image processing apparatus that causes a projection unit to project an image and determines luminance correction values with respect to an overlap region and a non-overlap region of a plurality of images constituting a multi-screen display, the apparatus comprising:

at least one processor; and a memory storing a program to be executed by the at least one processor, wherein the at least one processor executes the program to perform the functions of:

designating a position related to a boundary between the overlap region, where a projection region of the projection unit and a projection region of other projection unit is overlapped, and the non-overlap region, which is within the projection region of the projection unit and is not overlapped with the projection region of the other projection region;

dividing the overlap region and non-overlap region of the images into a grid with set units of processing, wherein the set units of processing are made smaller in a region nearest to the boundary between the overlap region and the non-overlap region;

determining luminance correction values for a luminance correction region, which is a region larger than the non-overlap region within the projection region of the projection unit and which overlaps the boundary between the overlap region and the non-overlap region, so that luminance values in the luminance correction region increase, wherein a luminance correction value is determined for each unit of processing; and increasing luminance of an image signal corresponding to the luminance correction region according to the determined luminance correction values.

2. The apparatus according to claim 1, wherein the determining determines the luminance correction values in the luminance correction region so as to make the values linearly change from a value preset in the overlap region to a value preset in the non-overlap region.

3. The apparatus according to claim 1, wherein the determining determines the luminance correction value as a second correction value based on a plurality of first correction values for correcting a low gradation luminance assigned to each of the set units of processing.

4. The apparatus according to claim 3, further comprising a look-up table configured to store a low gradation luminance correction value in correspondence with the unit of processing.

5. The apparatus according to claim 3, wherein a unit of processing in a region of a portion including a portion within a predetermined distance from the position is smaller in size than a unit of processing in a remaining region.

6. The apparatus according to claim 3, wherein the at least one processor performing the function of adding a luminance correction value determined by the determination unit to an image signal having undergone luminance correction in the overlap region.

7. The apparatus according to claim 6, wherein the projection unit is configured to project the image signal to which the luminance correction value is added.

8. The apparatus according to claim 1, wherein the determining determines the luminance correction value in the luminance correction region as a second correction value by weighting processing for each of the plurality of first correction values assigned to the units of processing.

9. The apparatus according to claim 8, wherein the determining performs the weighting processing by using any one of a plurality of sets of weighting coefficients for the weighting processing which are prepared in accordance with the position designated.

10. The apparatus according to claim 1, wherein the determination unit determines the luminance correction values for the luminance correction region so as to make the luminance correction values gradually change from the overlap region throughout the non-overlap region.

11. The apparatus according to claim 1, wherein the determination unit determines the luminance correction values for the luminance correction region in a case where the projection unit projects the image having low gradation values lower than a predetermined gradation value.

12. An image processing method in an image processing apparatus that causes a projection unit to project an image and determines luminance correction values with respect to an overlap region and a non-overlap region of a plurality of images constituting a multi-screen display, the method comprising:

designating position related to a boundary between the overlap region where a projection region of the projection unit and a projection region of other projection unit is overlapped and the non-overlap region which is within the projection region of the projection unit and is not overlapped with the projection region of the other projection region;

dividing the overlap region and non-overlap region of the images into a grid with set units of processing, wherein the set units of processing are made smaller in a region nearest to the boundary between the overlap region and the non-overlap region;

determining luminance correction values for a luminance correction region, which is a region larger than the non-overlap region within the projection region of the projection unit and which overlaps the boundary between the overlap region and the non-overlap region, so that luminance values in the luminance correction region increase, wherein a luminance correction value is determined for each unit of processing; and increasing luminance of image signal corresponding to the luminance correction region according to the determined luminance correction values.

13. A non-transitory computer-readable storage medium storing a program for causing a computer to execute a method for an image processing apparatus that causes a projection unit to project an image and determines luminance correction values with respect to an overlap region and a non-overlap region of a plurality of images constituting a multi-screen display, the method comprising:

designating a position related to a boundary between the overlap region where a projection region of the projection unit and a projection region of other projection unit is overlapped and the non-overlap region which is within the projection region of the projection unit and is not overlapped with the projection region of the other projection region;

dividing the overlap region and non-overlap region of the images into a grid with set units of processing, wherein the set units of processing are made smaller in a region nearest to the boundary between the overlap region and the non-overlap region;

determining luminance correction values for a luminance correction region, which is a region larger than the non-overlap region within the projection region of the projection unit and which overlaps the boundary between the overlap region and the non-overlap region, so that luminance values in the luminance correction region increase, wherein a luminance correction value is determined for each unit of processing; and increasing luminance of image signal corresponding to the luminance correction region according to the determined luminance correction values.

* * * * *